US006367874B2

(12) United States Patent
Casini

(10) Patent No.: US 6,367,874 B2
(45) Date of Patent: Apr. 9, 2002

(54) MULTI-FUNCTIONAL FURNITURE

(75) Inventor: Francesco Anthony Casini, Miami, FL (US)

(73) Assignee: Francesco Casini, Miami, FL (US)

( * ) Notice: Subject to any disclaimer, the term of this patent is extended or adjusted under 35 U.S.C. 154(b) by 0 days.

(21) Appl. No.: 09/775,734

(22) Filed: Apr. 2, 2001

Related U.S. Application Data

(63) Continuation of application No. 09/082,817, filed on May 21, 1998.

(51) Int. Cl.[7] ..... A47C 13/00

(52) U.S. Cl. ..... 297/118; 297/130; 297/440.14; 297/3

(58) Field of Search ..... 297/118, 119, 297/130, 135, 153, 170, 217.1, 258.1, 271.5, 283.1, 283.2, 283.3, 440.1, 440.14, 3, 1

(56) References Cited

U.S. PATENT DOCUMENTS 2,776,700 A * 1/1957 Potter et al.
3,001,822 A * 9/1961 Pagliaro et al.
3,233,942 A * 2/1966 Creutz
3,570,418 A * 3/1971 Gooding
3,584,916 A * 6/1971 Bayes
4,205,876 A * 6/1980 Cetina
4,588,227 A * 5/1986 Austin
5,104,179 A * 4/1992 Jones
5,415,454 A * 5/1995 Fu-Tsung
5,634,687 A * 6/1997 Gamble

* cited by examiner

*Primary Examiner*—Milton Nelson, Jr.

(57) ABSTRACT

A multi-functional children's convertible furniture article which can be utilized for a number of different purposes including a bassinet, cradle, bench, desk, rocking bench, high chair, or changing table. The device includes a main frame h shaped member and two supported sides that are rotatable. The furniture article achieves all of its intended uses without disassembly. The main frame component is flat on one edge and curved on the opposite edge allowing for a rocking action in one disposition and stabilization when capsized. The main frame component allows for attachable legs to achieve its high position components. The rotatable sides have been designed to swivel up or down, singly or in unison. All of the furniture articles positions are achieved when combining one or more of the units actions.

7 Claims, 8 Drawing Sheets

MULTI-FUNCTIONAL FURNITURE

The present application is a continuing application of copending U.S. patent application Ser. No. 09/082,817, filed May 21, 1998.

BACKGROUND OF THE INVENTION

1. Field of the Invention

The present invention relates to multi-functional furniture. More particularly, the disclosed invention relates to "knock-down" furniture which, because of its unique designs, and its unique methodologies of connecting the various modular components, can be easily assembled into a number of different configurations, dissassembled from its particular existing configuration at a given time, and reassembled into a number of different specific furniture unit configurations. In preferred embodiments, these multiple configurations are directed to children's furniture, but can be adapted to furniture which is suitable for utilization throughout late childhood, and up to and including adulthood, by simply modifying the dimensions of the various components of the furniture to facilitate larger sizes In the children's embodiments, the various units comprise a low bassinet, a high bassinet, a cradle, a rocking chair, a rocking chair with desk, a bench, a bench with desk, a changing table, a high chair, a stroller, a double stroller, etc.

Particular features of the disclosed invention are its multiple functionality, its modularity, its ease of conversion from one configuration to another, its rugged construction, its continued functionality of use from newborn infancy, through toddler stage, and up to and through early childhood, and by modifying the dimensions, up to and including adulthood.

Additionaly, because of the rugged construction, the disclosed invention can endure for many years, and can be utilized for each newborn child as the older sibling grows beyond the need for its use.

2. Description of the Prior Art

Multi-functional furniture has been disclosed in the prior art.

For example U.S. Pat. No. 2,620,018 to Joseph J. Pagano discloses convertible furniture which is comprised of two chair sections which may be utilized as stand alone units or arranged in juxtaposition to one another to form a hassock or a coffee table, Depending upon the manner in which the interlocking chair sections are juxtaposed, or whether the removable legs are maintained on the unit or detached when the juxtaposition occurs, the dimensions of the hassok and the coffee table can be modified to suit the particular size desired.

U.S. Pat. No. 1,453,241 to Duffield, discloses toy furniture made up of sheet metal parts having a construction and arrangement of coupling or junction between the points which enable the parts to be assembled or separated and which give the user the ability to assemble different furniture configurations. The primary methodology of coupling disclosed is a slot and tongue methodology of coupling.

One of the disadvantages of the furniture units disclosed in the Pagano Patent is that the various components which make up the units are attached, in part by screws which require considerable work in the breaking down and the reassembling of the units in juxtaposition to one another in order to arrive at the desired configuration, or to change the dimension of a given unit.

Another disadvantage is that the disclosed invention shows only four utilizable units—two chairs, a hassock and an end table, and several size-related embodiments.

Still another disadvantage of the disclosed prior art of Pagano, in view of Duffield is the fact that the disclosed units have a limited sphere of use in that none of the embodiments disclose an easy and efficient methodology of moving said embodiments from one place to another within the immediate "sphere of their intended use" or of transporting said embodiments to "remote spheres of use", where said embodiments can be reassembled to be utilized in that "sphere".

In accordance with the present invention, articles of manufacture are disclosed which provide for extreme modularity, ease of conversion from one configuration to another, allowing for a multiplicity of units to be formed, ease of conversion to a configuration which allows for transportability within the intended "sphere of use", and ease of transportation to "remote spheres of intended use" for reassembly to be utilized in that "sphere".

SUMMARY OF THE INVENTION

An article of manufacture composed of breakdown furniture comprising:

A front component;

A rear component;

A bottom component;

Side components all of the aforesaid components being provided with means of connection of front component to rear component, said means of connection being slideably disposable within said components, allowing for said side and bottom components to be swivelly movable around an axis of motion, and in so being swivelly movable around an axis of motion, having the ability to facilitate the rearrangement of said side components and bottom component, such that said side components can be placed in juxtaposition to said front, rear, and bottom components and one another, so as to create a number of different resulting furniture unit configurations, and to facilitate convenient assembly, disassembly, and reassembly.

In a preferred embodiment said front and rear components are provided with detachable means of locomtion such that said means of locomotion allow for use of said article of manufacture throughout a local, "sphere of use". In yet another preferred embodiment, said article of manufacture is provided with means of transportation of said article of manufacture in its disassembled state to different places for reassembly and use in a "remote sphere of use". In still another preferred embodiment said means of transportation is adaptable, upon the attachment of means of elevation, to be provided with the ability to be utilized as an elevated platform, such as a table.

DETAILED DESCRIPTION OF THE INVENTION

Figure 1:
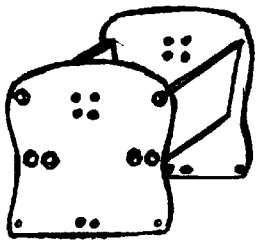
FIG. 1 is a perspective representation of a low bassinet embodiment of the invention.

As used throughout the specification and the appended claims, the term "children's knock down furniture" is intended to mean childrens furniture which has a great deal of modularity and ability to be easily assembled, disassembled, reconfigured, and reassembled to change from one furniture unit to another by the simple rearrangement of the components which make up a given unit, by changing the manner in which said components are placed in juxtaposition to one another.

Also included within the definition of "knock down" furniture is the ability, to add on additional components such as "legs" to change the vertical dimensions of the particular unit to which said legs or vertical extensions are attached, handles, which, when attached, can be used for providing leverage in moving the particular unit to which they are attached, and snap-on wheels as means of locomotion.

Still another aspect of the definition of children's "knock down" furniture is the differential shapes (flat, and curved or bevelled) associated with the top and bottom of the front and rear components which allow for the changing of the function of the assembled or reassembled unit when the top and bottom of the components of the unit are flip-flopped.

For instance, when the bottom of the front and rear components is flat, there is provided a stable unit configuration which does not sway backward and forward.

This type of unit is suitable for a bassinet, a changing table, a bench, and any furniture unit which requires a stable configuration.

When the unit is configured with the curved or bevelled side of the front and rear components in the downward orientation, the unit is suitable for a cradle, or a rocking chair or any type of unit which is designed to provide a rocking motion or to sway back and forth.

The term "detachable means of locomtion" is intended to refer to a snap-on wheel assembly which can be easily attached to the bottom of the front and rear components when said components are in the configuration wherein the flat side of the front and rear components are oriented in the down position.

Additionally, the front and rear components may be scaled down in size, and attached in juxtaposition to one another such that when they are attached to a detachable means of locomotion, they provide an ideal size for a stroller.

Additionally, the scaled down components may be provided in multiple sets so as to allow for multiple stroller configurations in a side by side or front and back multiple stroller configuration.

The phrase "use of said article of manufacture in a local, intended sphere of use" is intended to refer to the ability of the invention to be converted to a stroller-type unit for the transportation of a child in a local sphere such as the home, the supermarket, the park, or some other local instrumentality. It is noted that the phrase "use of said article of manufacture in a local, intended sphere of use", is not intended to be limited to the original "local sphere of use", in which the unit was situated.

This term is read broadly enough to encompass a sphere of use in which the unit ultimately is utilized on a temporary or permanent basis.

For example, the unit might be purchased, and utilized in location A. Any utilization of the unit in a sphere of use which is local to location A would be a local sphere of use.

The unit is transported to location B which is a city somewhat distant, and is assembled for use as a means of transportation of the child.

The use of the unit in spheres of use of location B would fit within the definition of local spheres of use, The phrase "means of transport of said article of manufacture in its dissembled state to different places for reassembly and use in a remote sphere of use, said means of transport being adaptable, upon the attachment of means of elevation, to be provided with the ability to be utilized as a table", is intended to refer to a carrying case which can be utilized to transport the entire set of components in their broken down dissassembled condition from one place to another, after which the unit can be reassembled for use in the new location.

The carrying case can be adaptable to be fitted with means of locomotion, in particular, wheels, so that it can be easily transported by the alleviation of the, weight of carrying.

Said carrying case is also provided with fittings to allow the attachment of verticle extensions or "legs" so that once it has been utilized to transport the unassembled or disassembled unit, the elevation of the carrying case by the attachment of the "legs" make it suitable for use as a table.

The term "means of connection of front component to rear component" refers to but is not limited to, metal threaded rods which fit into holes in the front and rear components, and slide through slots which extend lengthwise into the side and bottom components in order to connect the front and rear components to said side and bottom components.

Said metal threaded rods are hold in place at the front and rear components by knobs which are provided with receiving treads which can easliy be screwed into place without the need for tools. Said knobs which hold the metal threaded rods in place are an integral part of the afore-mentioned connection means, and are intended to fit squarely within that definition.

It can readily be appreciated that the metal threaded rod and metal threaded receiving knob methodology of connection can facilitate the ability of the side components to quickly and easily swivel up or down to arrive at the desired configuration.

For example, side components, 2, can be swiveled upward or downward, or completely detached and re-attached in a different position to double as various types of components to arrive at a specific configuration.

Figure 10:
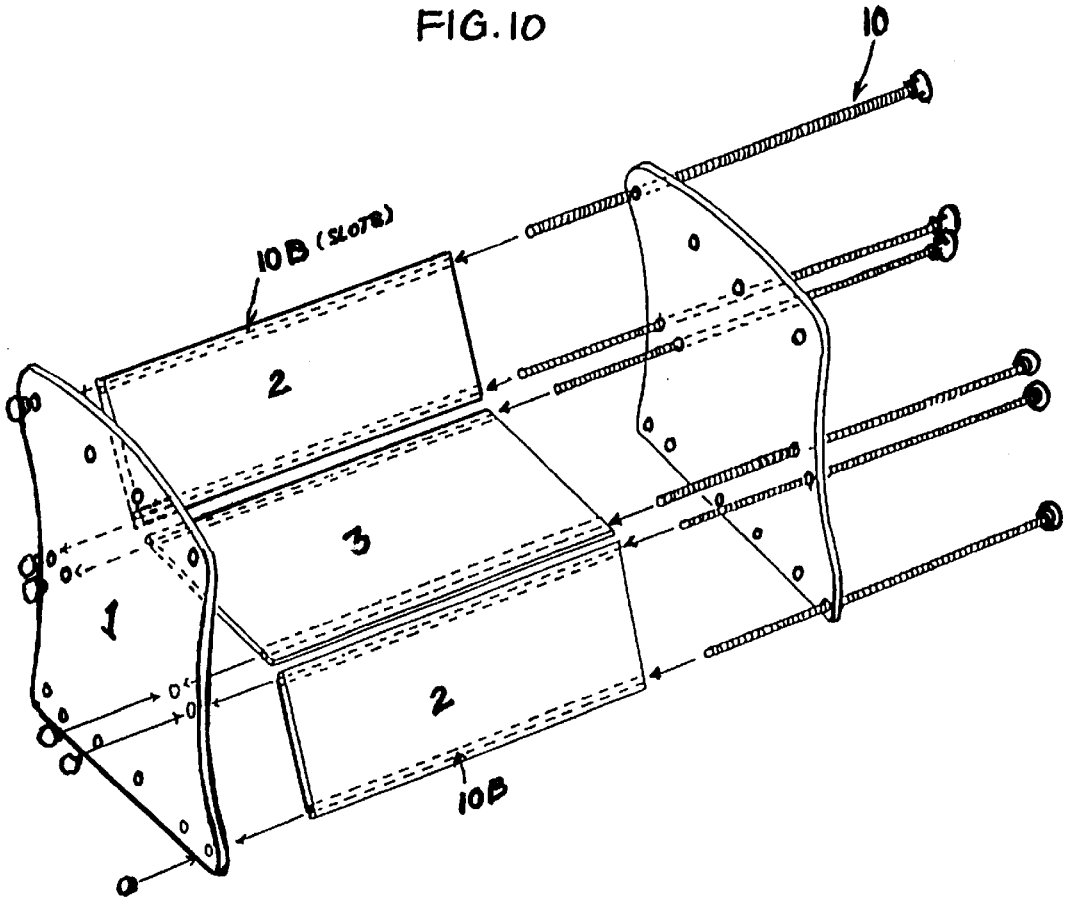
FIG. 10 is a detailed view of the bench configuration of FIG. 5 shown with dotted lines, along with the various components which make up said bench configuration in juxtaposition with one another.

Specifically, side component, 2, which is situated at the front position of bottom component, 3, and is shown in its flipped-down position in FIG. 10, can be flipped uppwardly and attached at holes, outer side holes, 5, to arrive at the bassinet configuration of FIG. 1. Thus the side component, 2, which is situated at the front and bottom of the bench unit, also doubles as, and is shown as flipped-up, front component, 2, in the bassinet configuration shown in FIG. 1.

Also included within the definition of the connection means is any means of connection of front to rear componenet which provides for the facilitation of the rearrangement of the various components in relationship to one another which allows for the aforesaid modularity.

For example, while the threaded rod means of connection which extends the entire length of the side and bottom crosswise components is the preferred embodiment because of the inherent strength of this configuration, other means of connection which do not extend the entire length of the component are also within the definition of the invention.

Specifically, a knob containing threads which can be disposed within receiving threads which are seated within the first inch or so of a groove in the side components, when tightly connected, can also serve as a suitable connection means.

The key feature of the connection means is its ability to facilitate the rotatable juxtaposability of each of the components in relationship to one another which allows for the rapid and efficient conversion of one unit to another.

The various components of the invention may be constructed of a multiplicity of materials which include but are not limited to various types of woods and substances which fall into the general definition of plastics and are suitable for use in injection molding, blow molding, extrusion molding and the like.

For example, suitable plastics for construction of the units, are comprised of materials such as polyethylene, polypropylene, polyvinyl chloride and the like.

In an embodiment which utilizes plastic, but is designed to capture a more up-scale market, a plastic having a wood veneer finish may be utilized as the finishing material.

The article of manufacture of the disclosed invention can be further understood and illustrated by reference to the following preferred embodiments.

DESCRIPTION OF THE PREFERRED EMBODIMENTS

Figure 5:
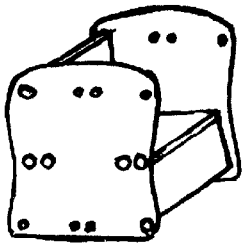
FIG. 5 is a perspective representation of a bench embodiment of the invention.

Referring first to FIG. 10, a detailed view of the bench configuration of FIG. 5 is shown with dotted lines, with the various components which make up said bench configuration in juxtaposition with one another.

In said bench configuration, front and rear components, 1, are illustrated along with side components 2 (the side component, 2, which is situated at the font of the unit also doubles as, and is shown as flipped-down front, and bottom component, 2).

Additionally shown are connecting means 10 (treaded metal rods), which, when the bench unit is assembled, are disposed within grooves 10-B (indicated by dotted lines, which run the lengths of components 2 and 3), and knobs, 11.

Figure 13:
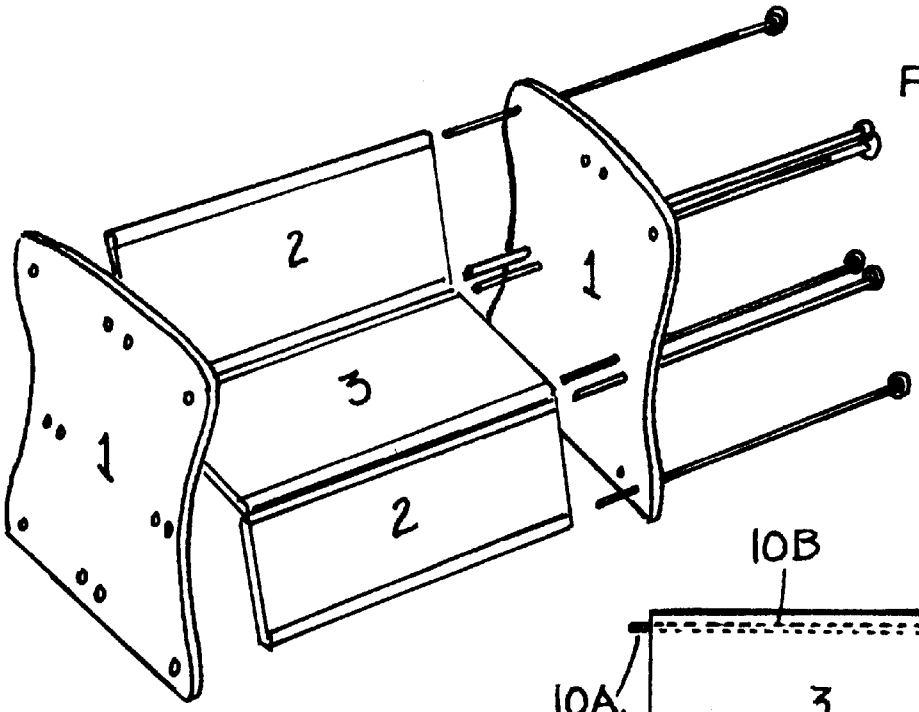
FIGS. 13, 14 and 15 are collectively, a detailed representation of the bench embodiment of the invention.

Referring to FIG. 13, a solid view of the bench configuration of FIG. 5 is shown with various components in juxtaposition with one another.

Figure 14:
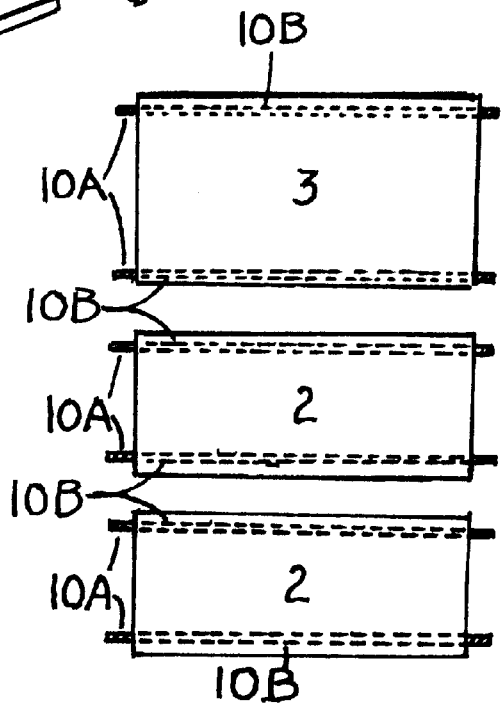

Referring to FIG. 14, bottom component 3 and side components 2 are shown with connecting means 10 disposed within grooves 10-A which extend the entire length of side components 2 and bottom component 3.

Figure 15:
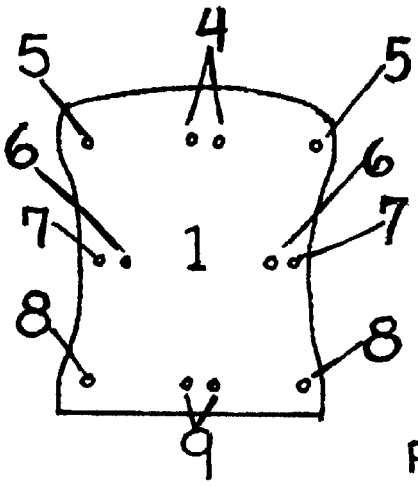

Referring next to FIG. 15, front component, 1, and rear component, 1, are shown with upper inner holes—4, upper side holes—5, inner middle side holes 6, outer middle side holes 7, lower outer side holes 8, and lower inner side holes 9.

Figure 16:
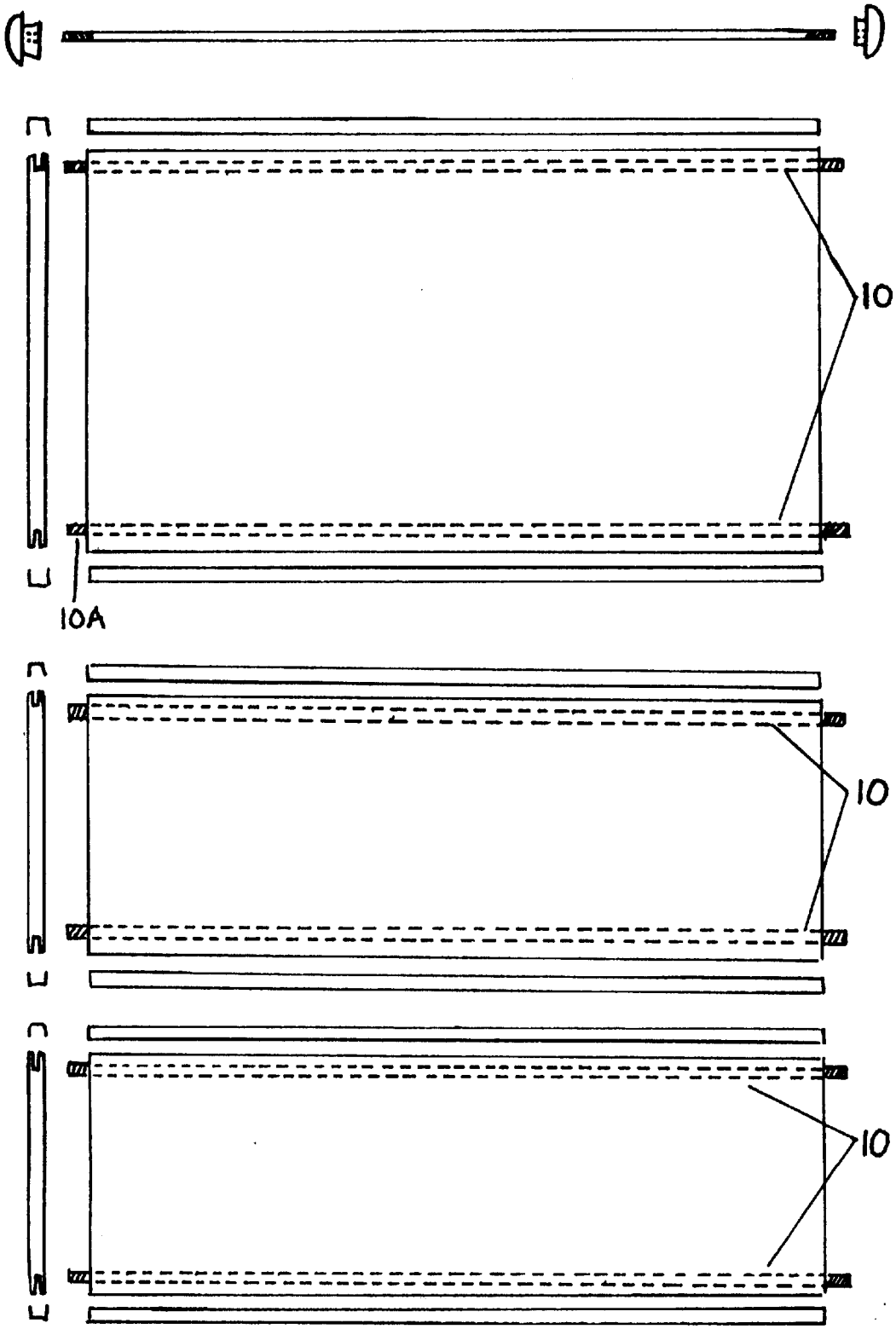
FIG. 16 is, a detailed representation of the connection means which are utilized to connect the font and rear components of the invention to one another, said connection means consisting of threaded steel connection rods, disposed within upper inner holes, upper side holes, inner middle side holes, outer middle side holes, lower outer side holes, and lower inner side holes, side and bottom components 2 and 3, and threaded receiving knobs.
Figure 17:
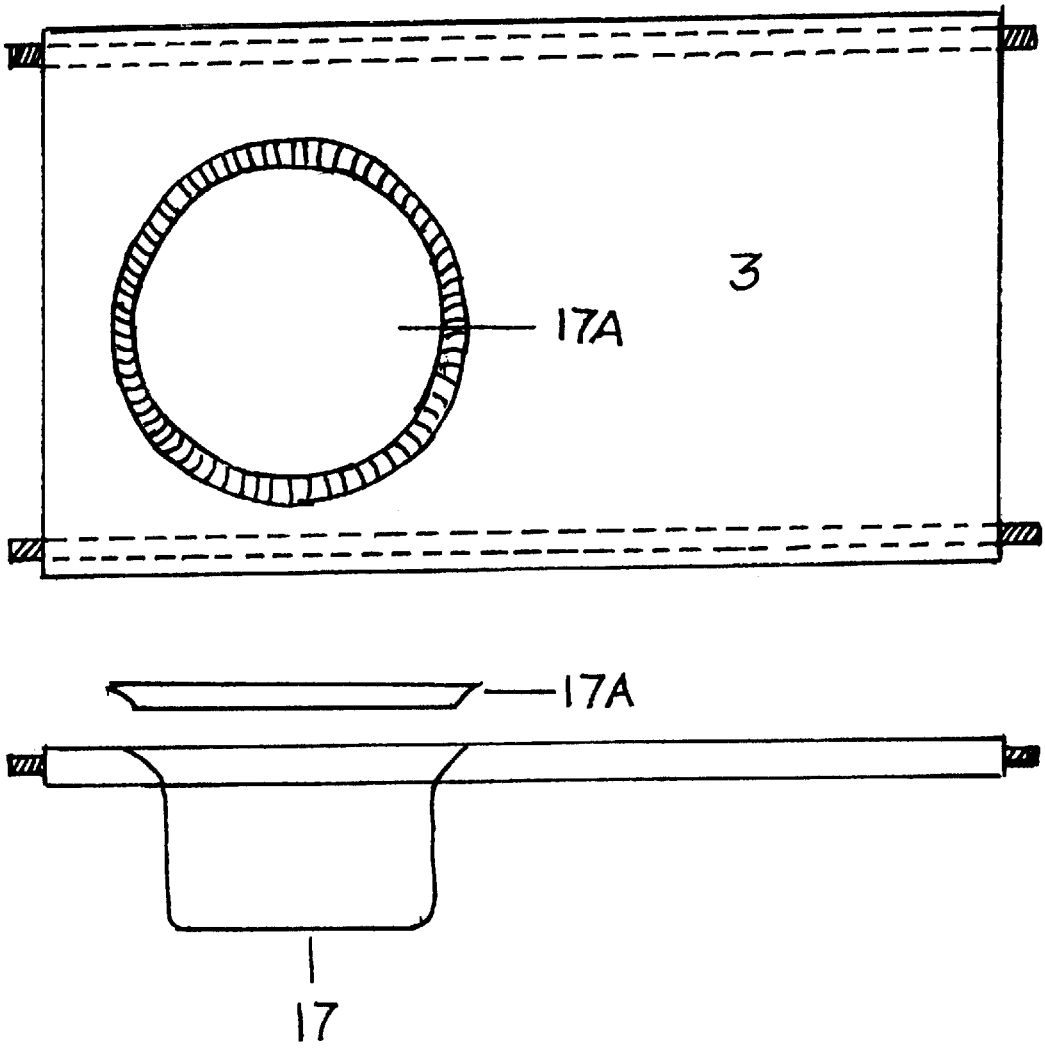
FIG. 17 is a representation of bottom component, 3, which is provided with a potty seat and covering top embodiment.

Referring to FIG. 16, depicted is the detail of the manner in which the connecting means, 10 (threaded metal rods which extend the length of side and flipped down bottom components 2 and bottom component 3), are disposed with said side, and flipped down bottom components 2, and bottom component 3.

Also shown in FIG. 16 are knobs, 11, which are affixed with receiving threads, 11-A.

The above holes, (upper inner holes—4, upper side holes—5, inner middle side holes 6, outer middle side holes 7, lower outer side holes 8, and lower inner side holes 9), which are drilled into front and back components, 1, are adapted for the accommodation of connection means which allow for the various components of the invention to be swivelly movable about a radius of motion to allow for the swift and easy assembly, disassembly, and re-assembly of the unit into its many configurations.

For example, starting with the bench configuration as shown in FIG. 13, front and rear components, 1 are situated so that the flat edge is oriented in the down position in order to provide for a stable base consistent with the fact that the desired unit is a bench as opposed to a cradle or rocking chair, or other configuration in which the ability to rock back and forth is desired, in which case the bevelled shape would have been oriented in the down position.

Referring to FIG. 13 in the abovementioned bench configuration, connecting rods, 10, are disposed within upper side holes, 5, and slideably disposed within groves, 10-B, which have been bored out of the entire length of the top portion of side component, 2.

In said bench embodiment, connecting rods 10 are also disposed within outer middle holes, 7, and slideably disposed within grooves, 10-B, which have been bored out of the entire length of the bottom portion of side component, 2.

Said connecting rods, 10, are provided with threads, 10-A, at either end so as to allow for connection and securing of said connecting rods in a tight, secure, position by the attachment of knobs, 11, which are provided with receiving threads, 11-A.

The affixing of knobs, 11, to connecting rods, 10, provides a sturdy back base for the above-mentioned bench configuration of the invention.

In the above-mentioned bench configuration of the invention, connecting rods, 10, are also disposed within inner middle holes, 6, and slideably disposed within grooves, 10-B, which are bored out of, and run the length of the front and rear portions of bottom component, 3.

Said connecting rods, 10, when slideably disposed within the front and rear grooves, 10-B, of bottom component, 3, when affixed in place by knobs, 11, provide a stable platform and anchor for the seat portion of said bench configuration.

In the aforesaid bench embodiment, connecting rods, 10, are also disposed within inner middle holes, 6, situated at the forward position of bottom component, 3, and slideably disposed within grooves, 10-B, which are bored out the length of, and along the font side of bottom component, 3.

Said connecting rods, 10, are also disposed within outer middle holes, 7, and slideably disposed in groove, 10-B, which runs the length of the top side of said side component, 2, when it is in the flip-down position.

Said connecting rods, 10, are also disposed within lower side holes, 8, and slideably disposed within groove, 10-B, which runs the entire length of the lower position of component, 2, when it is in the flip-down position.

This second side component, 2, provides an anchoring cross bar at the bottom of the bench configuration when it is in the flip-down position.

In all of the aforementioned embodiments, it is a special feature of the invention that the various components are affixed with grooves, 10-B, such that connection means, 10, are slideably disoposable within grooves 10-B, and/or said components are rotatably disposable around the axis of connection means, 10, so as to arrive at numerous configurations For example, in FIG. 10, the side component, 2, which is situated at the front position in relationship to bottom component, 3, is rotatably disposable around the axis of connecting rod, 10, and as such, when it is rotated upwardly, starting from the bench configuration wherein it is in the flip-down position, it can be attached in its upward rotation, to upper side holes, 5. In so doing, the seat configuration is transformed into the bassinette configuration shown in FIG. 1.

Figure 2:
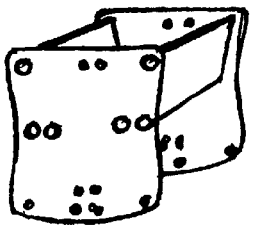
FIG. 2 is a perspective representation of a cradle embodiment of the invention.
Figure 3:
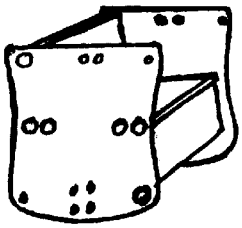
FIG. 3 is a perspective representation of a rocking chair embodiment of the invention.

Likewise, if the starting configuration had been the rocking chair configuration shown in FIG. 3, in which the bevelled edge of front and rear components, 1, had been oriented in the down position to provide the ability to sway back and forth, the rotation of side component, 2, from a bottom orientation to an upward orientation would provide the cradle configuration shown in FIG. 2.

Similarly, side component, 2, which is situated at the front of the bench unit which is shown in FIG. 5, (detail is shown in FIG. 10 with side component, 2, in its flip-down position) can be detached from the front portion of the bench unit by unscrewing receiving knobs, 11, from threaded connecting rods 10, which are disposed within holes 7, and 8, and grooves, 10-B, in, side component 2. Side component, 2, can then be placed in position such that connecting rods, 10, can be disposed within holes 4, and holes, 5, and slideably disposed within grooves, 10-B, such that the bench with desk configuration of FIG. 6 is formed.

Figure 4:
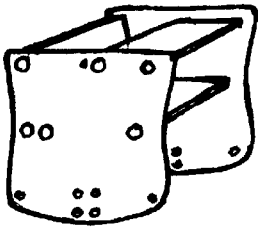
FIG. 4 is a perspective representation of a rocking chair with desk embodiment of the invention.

In a similar manner, the rocking chair with desk configuration of FIG. 4, can be formed by starting with the rocking chair embodiment of FIG. 3, removing the side component, 2, which (in FIG. 3), is in its flippe-down position, and placing said component, 2, in position such that connecting rods, 10, can be slideably disposed into grooves, 10-B, through holes 4, and holes 5, to arrive at the rocking chair with desk configuration shown in FIG. 4

Figure 6:
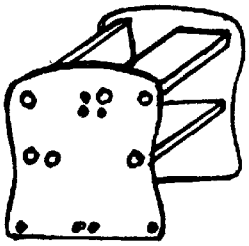
FIG. 6 is a perspective representation of a bench with desk embodiment of the invention.
Figure 19:
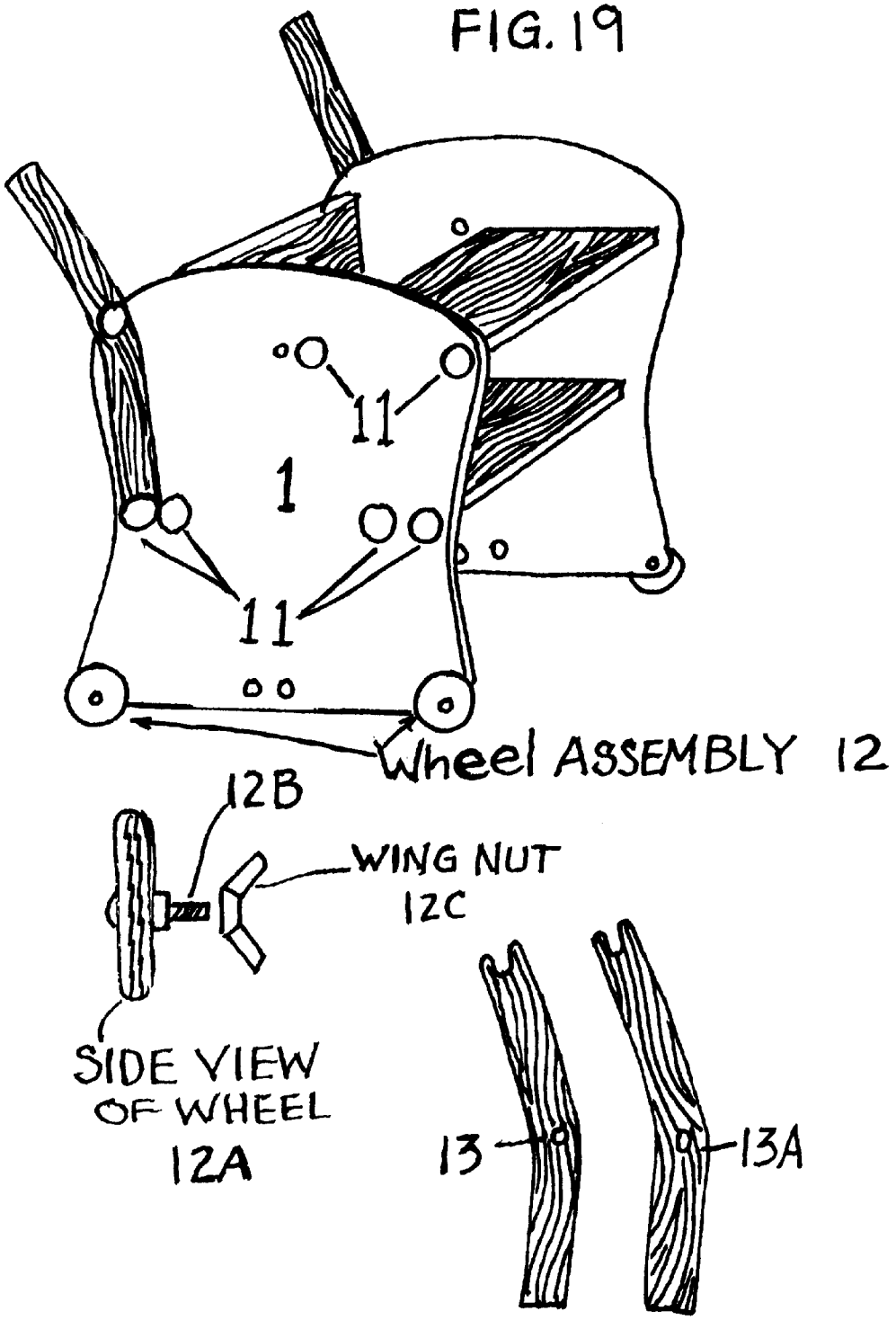
FIG. 19 is a stroller embodiment of the invention which has affixed thereto handles and detachable means of locomotion.

Referring to FIG. 19, the affixing of wheel assembly, 12, which are comprised of wheel, 12-A, threaded wheel component, 12-B, and winged nut component, 12-C, to the bottom of front and rear components, 1, by disposing said wheel nut assemblies within bottom side holes, 8, allows the bench with desk unit, disclosed in FIG. 6 to be transformed into a stroller configuration (shown in FIG. 19), which, when assembled, allows for locomotion in local or remote spheres of use.

The resulting stroller unit is preferably affixed with components, 13, as shown in FIG. 19, by anchoring said components to said stroller unit by the affixing of said components by means of attachment knobs, 11, which, when screwed into place, are seated in slots 13-B, shown in FIG. 19.

Figure 18:
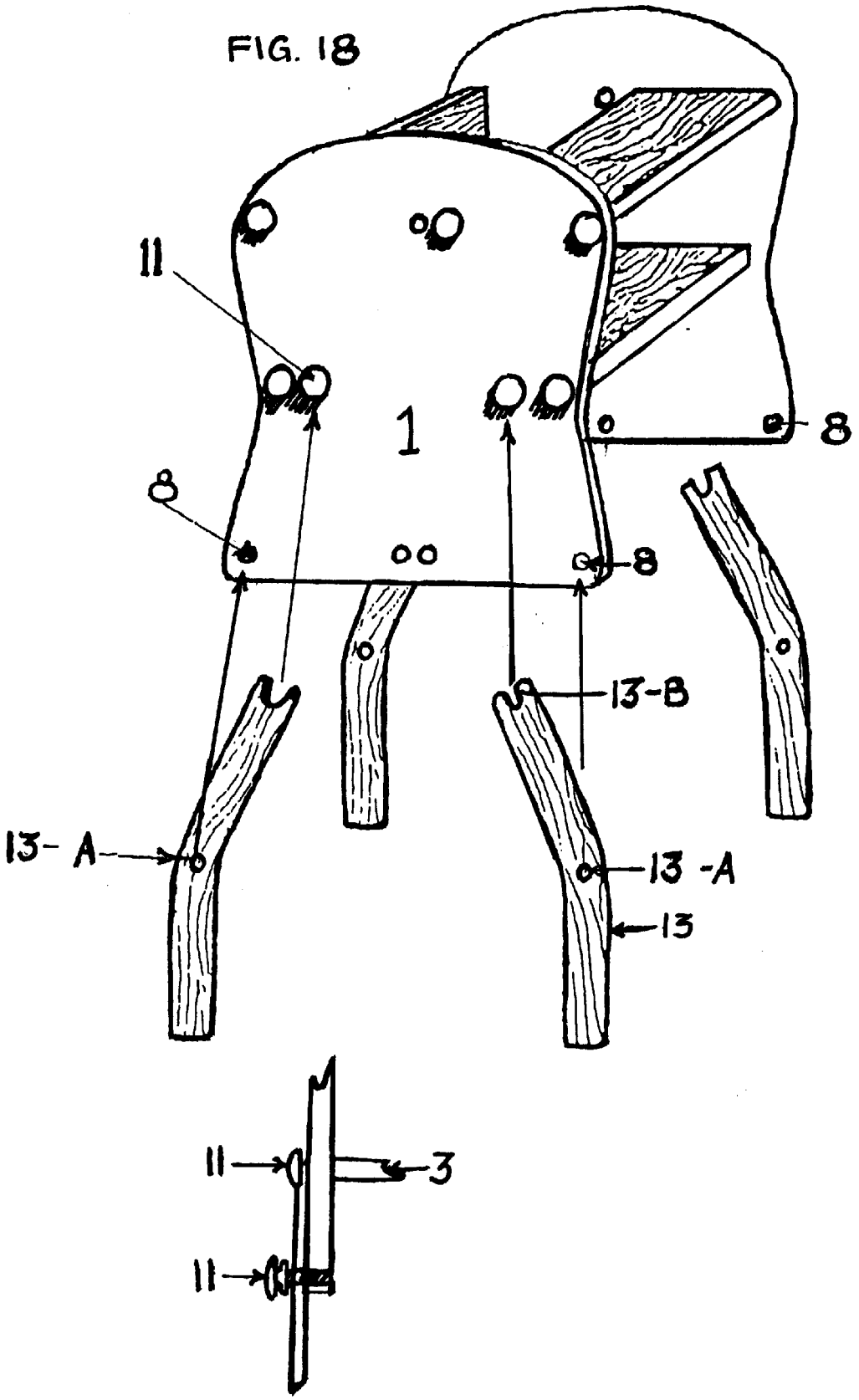
FIG. 18 is a representation of the bench with desk embodiment of the invention which shows the detail of the manner in which elevation means can be attached so as to arrive at the high chair, high bassinet, or changing table embodiments of the invention.

Attachment knob, 11, is affixed to components through holes, 13-A, by means of attachment screw, 14, shown in FIG. 18.

Figure 7:
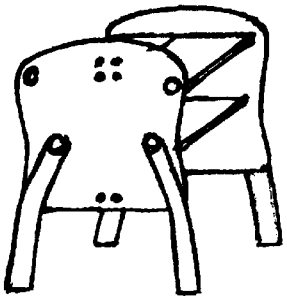
FIG. 7 is a perspective representation of a changing table embodiment of the invention.
Figure 8:
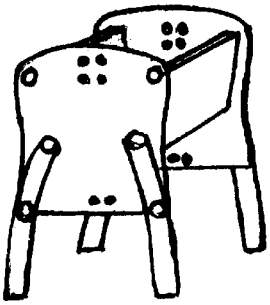
FIG. 8 is a perspective representation of a high bassinet embodiment of the invention.
Figure 9:
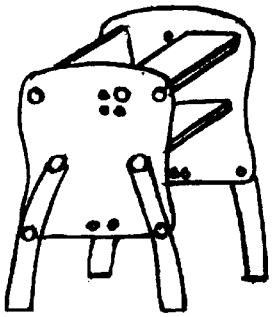
FIG. 9 is a perspective representation of a high chair embodiment of the invention.

Depending upon whether the components, 13, are in the upright or inverted position, said components can double as handles, for provding leverage for the stroller embodiment as shown in FIG. 19, or as means for elevating the unit, such as legs, 13, in which case said unit would be functional as a high bassinet, shown in FIG. 8, a high chair shown in FIG. 9 or a changing table shown in FIG. 7.

Figure 11:
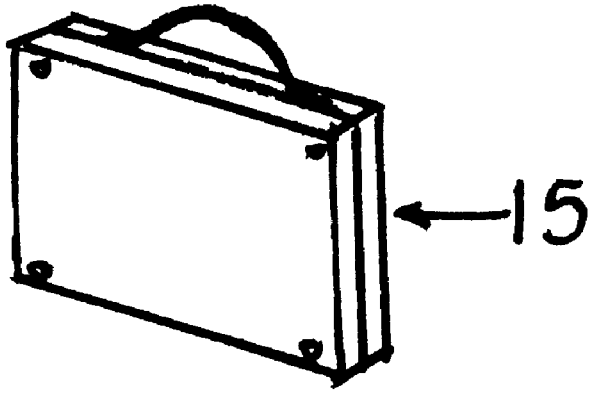
FIG. 11 shows a carrying case which can be utilized to transport the unassembled or dissassembled invention.

Referring to FIG. 11, the carrying case, 15, which can be used to transport the article of manufacture of the invention can be adapted for easy facilitation of transportation by the affixing of locomotion means such as wheel assembly, 12, shown in FIG. 19.

Figure 12:
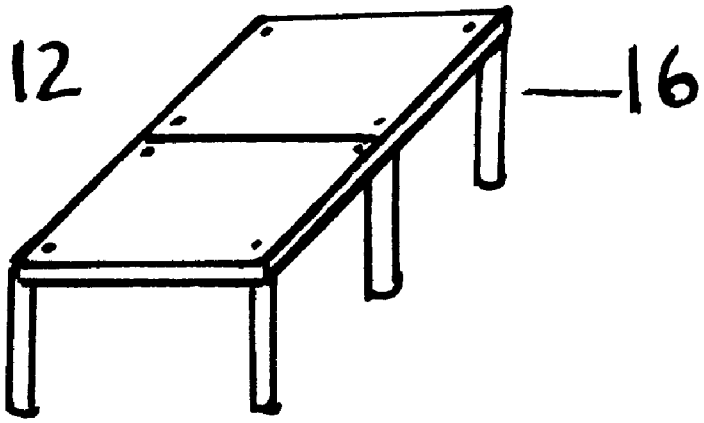
FIG. 12 shows a two tables which can be configured from the carrying case, one table by attaching detachable legs to the carrying case in its open position, and another table half the size by attaching detachable legs in the folded position of the carrying case.
Figure 12:
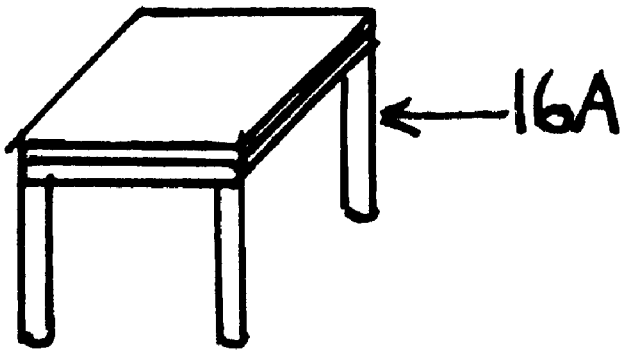

Referring to FIG. 12, said carrying case, 15, can be adapted to a table configuration, 16, by the attachment of elevation means to the carrying case when it is in the open position shown in FIG. 12. Another table configuration 16-A, which is half the size of the above configuration may be arrived at by attaching elevation means to the carrying case when it is in the folded configuration.

In still another preferred embodiment, the bottom component 3 is provided with a potty container, 17, which has a top portion, 17-A, which fits into potty container, 17, in a flush manner when the potty is not being used, and thus, bottom component, 3, can double as the componenet for a seat as well as the potty training component.

Also, shown, in FIG. 18 is a detailed view of the manner in which elevation means can be utilized to modify the vertical dimensions of the basic units to reconfigure one unit into another, and to change said unit's functionality.

For example, legs, 13, are provided with holes, 13-A, which can be connected to outer bottom holes, 8, and inner middle holes, 6, in front and rear components, 1.

The connection through holes 13-A is accomplished by the affixing of attachment of attachment screw, 14, to receiving knob, 11, as shown in FIG. 18.

Likewise, the top portion of legs, 13, as indicated by notch, 13-A mah be attached as the seating means for said legs, by the attachment of seating knob, 11, to attachment screw, 14, through inner middle hole, 6, when it is desired to add to the height of the particular unit so as to provide a high chair, a high bassinet, or a changing table.

What is claimed is:

1. A multi-functional furniture unit comprising:

a front component, a rear component, a bottom component, and plural side components;

said front and rear components being flat at one of a top or bottom side thereof, and curved at the other of said top or bottom side thereof;

each of said bottom and side components including longitudinally extending elongated grooves;

each of said front and rear components including a plurality of holes extending therethrough;

each of said components including a means of connection of said front component to said rear component;

said means of connection being slidably disposable within said components, thereby allowing each of said bottom and side components to be detachably connected to said front and rear components and swivelly movable around a respective axis of motion, thereby providing for selective rearrangement of said bottom and side components relative to one another and to the front and rear components to create a number of different furniture unit configurations, and to facilitate convenient assembly, disassembly, and reassembly;

said means of connection is a plurality of threaded rods and correspondingly threaded knobs; said threaded knobs being adapted to affixably receive said threaded rods;

said threaded rods adapted to be received in said holes and slidably received in said grooves;

said threaded rods adapted to extend the entire length of said grooves;

said threaded knobs adapted to be received in said holes for engaging the threaded rods and providing stability to the assembled unit.

2. The multi-functional furniture unit of claim 1, wherein said unit is provided with handles.

3. The multi-functional furniture unit of claim 1, wherein said unit is provided with a detachable wheel assembly.

4. The multi-functional furniture unit of claim 1, wherein said unit is provided with a carrying case for transporting the unit in its disassembled configuration, said carrying case is adapted to be affixed with legs for use as a table.

5. The multi-functional unit of claim 1, wherein said unit can be alternately configured as a low bassinet, cradle, rocking chair, rocking chair with a desk, bench, bench with a desk, high chair, changing table, and high bassinet.

6. The multi-functional furniture unit of claim 1, wherein the unit is provided with a potty.

7. The multi-functional furniture unit of claim 1, wherein the unit is provided with a plurality of legs.

* * * * *